United States Patent [19]

Treadwell et al.

[11] 4,205,644

[45] Jun. 3, 1980

[54] EXHAUST GAS RECIRCULATION VALVE WITH ADJUSTABLE PRESSURE TRANSDUCER

[75] Inventors: William A. Treadwell; Dudley P. Dunham, both of Battle Creek, Mich.

[73] Assignee: Eaton Corporation, Cleveland, Ohio

[21] Appl. No.: 927,790

[22] Filed: Jul. 25, 1978

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,756,210 | 9/1973 | Kuehl | 123/119 A |
| 3,880,129 | 4/1975 | Hollis Jr. | 123/119 A |
| 3,915,136 | 10/1975 | Caldwell | 123/119 A |
| 3,974,807 | 8/1976 | Nohira et al. | 123/119 A |
| 3,982,515 | 9/1976 | Bradshaw | 123/119 A |
| 4,116,182 | 9/1978 | Bradshaw | 123/119 A |

*Primary Examiner*—Wendell E. Burns

*Attorney, Agent, or Firm*—R. J. McCloskey; R. A. Johnston; E. C. Crist

[57] ABSTRACT

An exhaust gas recirculation valve assembly is provided for controlling the recirculation of exhaust gases in an internal combustion engine. The assembly includes a fixed body portion having an exhaust inlet and an exhaust outlet port and an adjustable exhaust back-pressure transducer portion movable within the valve. A diaphragm is attached to the body and to the upper and lower housing shells of the transducer to define in the body portion a vacuum chamber on one side and an atmospheric chamber on the other side. A second atmospheric or air bleed chamber and an exhaust chamber are provided by portions of the diaphragm in the transducer portion. The transducer has an air bleed valve responsive to exhaust back pressure which controls the vacuum in the vacuum chamber for effecting movement of a valve for controlling flow between the inlet and outlet. The back pressure transducer has an adjustment which includes a threaded member extending through the upper housing shell and engaging an annular seat registered over the upper end of a biasing compression spring, the lower end of which reacts against the transducer diaphragm. Selective advancement or retraction of the threaded member is effective for varying the magnitude of the biasing force on the diaphragm portion within the transducer.

6 Claims, 1 Drawing Figure

EXHAUST GAS RECIRCULATION VALVE WITH ADJUSTABLE PRESSURE TRANSDUCER

FIELD OF THE INVENTION

The present invention relates generally to an exhaust gas recirculation valve having an adjustable back-pressure transducer assembly for recirculating exhaust gases in an internal combustion engine.

BACKGROUND OF THE INVENTION

Exhaust gas recirculation valves for use in internal combustion engines which utilize therewithin a back-pressure transducer assembly are known. A problem encountered during assembly of the back-pressure transducer has been the difficulty of calibrating the open and closed position of the transducer air-bleed valve for a given range of exhaust gas back pressures. This difficulty has arisen primarily due to the broad tolerances on the free length of the biasing compression spring required for high volume production and the variation in stiffness of the flexible diaphragm, and the dimensional variation in the associated mating parts, primarily the upper and lower housing shells. In order to achieve proper back pressure transducer response for a given range of exhaust back pressures, it has heretofore been necessary to test, sort, and match a given compression spring with a flexible diaphragm having a given stiffness characteristic to achieve the resultant biasing effect required for proper transducer response. This sorting and matching procedure is inherently costly and does not provide the degree of repeatability required in most applications.

SUMMARY OF THE INVENTION

Accordingly, it is an object of the present invention to provide an exhaust gas recirculation valve (EGR) having an adjustable back pressure transducer which can be adjusted to respond within a precise range of exhaust back pressure conditions.

It is another object of the present invention to provide such an EGR valve having an adjustment feature which can overcome wide manufacturing tolerances in biasing spring loads and diaphragm stiffness.

A further object of the invention is to provide an adjustment feature for a back pressure transducer which can be locked and fluidly sealed in place after calibration.

It is yet another object of the invention to provide an adjustable back pressure transducer which utilizes low cost components.

DETAILED DESCRIPTION

Figure 1:
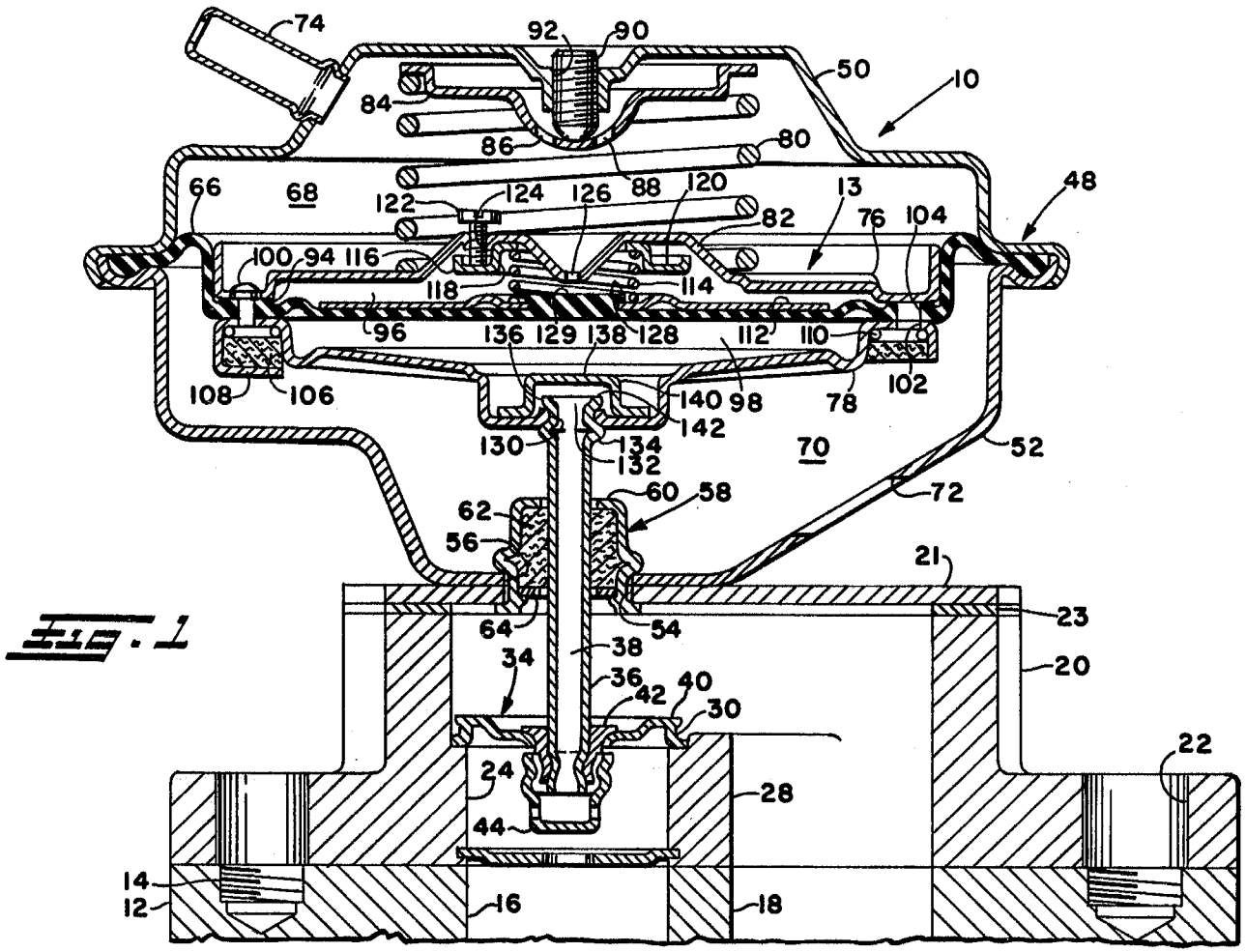
FIG. 1 is a vertical cross-sectional view of the EGR valve assembly of the present invention.

Referring now to FIG. 1, an exhaust gas recirculation (EGR) valve assembly indicated generally by reference numeral 10 is illustrated as being configured for mounting on a manifold boss portion 12 of an internal combustion engine. The EGR valve assembly includes a back pressure transducer subassembly indicated generally by reference numeral 13. The manifold boss portion includes a plurality of bolt-receiving bores 14, and has an exhaust passage 16 for providing pressurized fluid communication with the engine exhaust manifold, and an intake passage 18 for directing recirculated exhaust gas to the engine intake manifold.

The EGR valve assembly 10 includes a valve housing 20 which includes a plurality of bolt receiving bores 22 aligned with the bores 14 of manifold boss portion 12. The valve housing 20 further includes an exhaust gas inlet 24 in open communication with the exhaust passage 16 through an orifice 26 and an exhaust gas outlet 28 directly communicating with intake passage 18. A seat member 30 is fixedly secured to the valve housing 20 at the upper end of the exhaust gas inlet 24 to define an EGR orifice 32 with a recirculation valve subassembly 34 carried for axial movement with a hollow tubular valve stem member 36 which has an axially extending exhaust passage 38 formed therethrough. Subassembly 34 includes a sealing plate 40, a hub member 42 and a baffle shell member 44.

Baffle shell member 44 is formed as a cup shaped member and includes transverse baffle passages 46 which fluidly communicate exhaust gas from exhaust passage 16 to passage 38 of stem 36.

The upper end of the valve housing 20 is closed by a cover plate 21 and a gasket member 23 joined thereto by suitable fasteners (not shown). Attached to the upper surface of the cover plate 21 is a control housing indicated generally by reference numeral 48 having an upper portion 50 and a lower portion 52. Aligned bores 54, 56 are formed through the lower housing portion 52 and the cover plate 21, respectively, to receive a guide assembly, indicated generally by reference numeral 58 which slidingly receives the valve stem member 36.

The guide assembly 58 comprises a guide shell member 60, a bearing member 62, and a retaining washer 64.

Disposed between and sealingly engaging upper and lower housing portions 50, 52 is a pressure responsive member in the form of a flexible diaphragm 66 which thereby divides the control housing 48 into an upper vacuum chamber 68 and a lower atmospheric chamber 70 in communication with atmospheric air through openings 72. Vacuum chamber 68 is in communication with a vacuum source through a vacuum fitting 74.

Diaphragm 66 is also attached to the exhaust gas back pressure transducer assembly 13, being clamped between the rim portion of an upper housing shell 76 and the rim portion of a lower housing shell 78 thereof. The diaphragm 66 and the transducer assembly 13 are biased downward by a biasing spring 80. The spring 80 is seated at its lower end on the upper surface of member 76 and piloted about an upwardly extending centrally disposed protrusion 82 formed thereon. The spring 80 is seated at its upper end on a seat member 84 which includes a plurality of vacuum passages 86 formed therethrough. Seat member 84 further includes a centrally located concave upward portion 88 illustrated as defined by a spherical radius. The portion 84 abuts the spherical end of an adjusting screw 90 threadedly received in a threaded bore 92 in control housing upper portion 50.

Returning now in greater detail to the construction of the back pressure transducer subassembly 13, the diaphragm 66 includes an annular sealing portion 94 having upper and lower serrated surfaces, not shown, which abut rim surfaces of lower housing shell 78 and upper housing shell 76. The transducer 13 is thereby divided into an upper bleed air chamber 96 and a lower exhaust gas chamber 98. A plurality of rivets 100 extend through upper housing shell 76, annular sealing portion 94, and lower housing shell 78 to compressively engage the diaphragm 66 therebetween. Second sets of aligned bores 102, 104 are formed through the lower housing shell 78 and the sealing portion 94, respectively. Channel passages, not shown, are formed in the upper serrated surfaces to provide communication between the bores 104 and the upper air chamber 96. Fluid communication of the bores 104 with atmospheric air is effected through the bores 102 and a filter 106 retained by tang portions 108 of the lower member 78 and spaced from the bores 102 by a wire spacer 110.

A reinforcing plate 112 is fixed to the upper surface of the diaphragm 66, and the diaphragm 66 and plate 112 are biased downward by a second biasing spring 114 seated at its lower end on the reinforcing plate 112 and at its upper end against an annular abutment member 116. Abutment member 116 includes a cup shaped portion 118 which tends to maintain the upper end of biasing spring 114 registered therein. An outwardly extending flange 120 of abutment member 116 provides a contact surface for the lower end of an adjustment screw 122 which is threadedly received in a bore 124 of upper housing shell 76.

A centrally located air breathe passage 126 is formed through the transducer upper housing shell 76. A central raised control portion 128 is formed on diaphragm 66 and includes an upper surface 129 which functions as a bleed valve surface and is maintained in spaced relationship with respect to the air bleed passage 126 by the opposed forces of the second biasing spring 114 and the differential pressure acting on diaphragm 66 across exhaust gas chamber 98 and air bleed chamber 96. Prior to final assembly of back pressure transducer 13 between upper housing 50 and lower housing 52, the transducer is placed in a calibration fixture which maintains the volume of air above upper housing shell 76 at a pressure of 6.0 inches (152.5 mm) of Hg below atmospheric pressure at approximately room temperature. Exhaust chamber 98 is then subjected to a positive gauge pressure to simulate pressure exerted by the exhaust gas pressure in exhaust passage 16, at which point the bleed valve surface 129 is spaced from air bleed passage 126 an amount sufficient to allow a predetermined amount of flow therethrough. The air flow rate through air bleed passage 126 is first measured with adjustment screw 122 retracted. Biasing spring 114 has a free height and stiffness sized to permit bleed valve surface 129 to initially be spaced from air bleed passage 126 closer than design requirements call for, resulting in less flow rate for a given exhaust back pressure. To achieve the desired minimum flow rate, the adjusting screw 116 is advanced toward diaphragm 66 which tilts abutment member 116 downward resulting in an increased biasing effect from spring 114, which in turn increases the spacing between bleed valve surface 129 and air bleed passage 126 and consequently the flow rate through passage 126 is increased. Adjusting screw 116 is gradually advanced until the required flow rate is achieved and then locked in place by any commercially available anaerobic type locking compound. The gap between third valve surface 129 and the lower surface around air bleed passage 126 can be precisely controlled by this adjustment feature to control the flow of air from the back pressure transducer air chamber 96 to the vacuum chamber 68 for regulating or modulating the level of vacuum therein.

Lower housing shell 78 is formed to include a central bore 130 surrounded by an outward extending flange 132. A valve stem member 36 is provided and is preferably formed as a hollow tube having a bead 134 formed proximate the upper installed end thereof. The upper end of the valve stem member 36 is inserted through the bore 130 with the bead 134 abutting the bottom of lower housing shell 78. The end of the valve stem member is then crimped to form a second bead 136 which sealingly engages the flange 132 and axially retains the valve stem member 36 and thereby substantially prevents fluid communication between the transducer exhaust chamber 98 and the atmospheric chamber 70. A baffle plate 138 having apertures 140 formed therein is attached, as by welding at 142, to the lower housing shell 78 to cover the open end of the valve stem member 36.

The operation of the invention can best be understood by reference to FIG. 1 in which the valve assembly is shown in its neutral position. In this position the sealing plate 42 engages the valve seat 30 and the bleed valve surface 129 of diaphragm 66 is approximately at its maximum separation from the air bleed passage 126. A predetermined vacuum level must be present in the vacuum chamber 68 in order for the atmospheric pressure in chamber 70 to overcome the biasing force of the spring 80 to raise the back pressure transducer assembly 13 and consequently the valve stem member 36 and the recirculation valve subassembly 34 attached thereto. The vacuum level in the chamber 68 is determined by the vacuum source with which it is communicated through the fitting 74. In an internal combustion engine that vacuum source may be manifold vacuum downstream of the throttle plate but is preferably that vacuum referred to as venturi suction, taken from a location in the carburetor which is closed by the butterfly valve of the carburetor. The position of the recirculation valve assembly 34 is therefore seen to be directly responsive to induction passage vacuum levels in an engine.

Concurrently, the position of the bleed valve surface 129 of diaphragm 66 is responsive to the level of the exhaust gas pressure. When the datum back pressure, i.e., the positive gauge pressure exerted by the exhaust gas in the exhaust gas inlet 16 is transmitted to the exhaust chamber 98 of back pressure transducer assembly 13, it exerts a positive pressure against the lower surface of the diaphragm 66 tending to urge the bleed valve surface 129 upward as viewed in FIG. 1. When the pressure exerted by the exhaust gas rises above a predetermined datum back pressure level sufficient to overcome the combined downward forces exerted by the spring 114 and by atmospheric pressure in the air bleed chamber 98 (which is in direct fluid communication with the chamber 104 through the passages in diaphragm 66, described above, and the lower housing shell member 78 and through the filter member 106) the bleed valve surface 129 is moved to a position wherein it is closer to the air bleed passage 126, thereby restricting the flow of air from air bleed chamber 96 to the vacuum chamber 68. This flow restriction reduces the pressure, i.e., increases the vacuum in the vacuum chamber 68 and is thus operative to move the recirculation valve subassembly 34 upward in the same manner that an increase in vacuum level at the vacuum source tends to do. As the recirculation valve subassembly 34 is moved upward, the sealing plate is removed from abutting engagement with the seat 30. This permits exhaust gas to pass from the exhaust gas inlet to the exhaust gas outlet.

From the foregoing it should be clear that the operation of the entire valve assembly is continuously responsive to changes in both the exhaust gas pressure and the vacuum level in vacuum chamber 68. Thus, if the exhaust gas pressure in the exhaust gas inlet 60 decreases as a result in the decrease of engine load as the back pressure is relieved by the upward movement of the recirculation valve assembly 34, the bleed valve surface 129 tends to move toward the neutral position shown in FIG. 1. Movement toward this position permits an increased flow of air between the air bleed chamber 96 and the vacuum chamber 68 causing the absolute pressure in the vacuum chamber to increase, i.e., the vacuum level to decrease so that the biasing spring 80 can move the back pressure transducer assembly 13 downward toward its neutral position. As the neutral position is reached, the sealing plate contacts the seat 30 blocking fluid communication between exhaust passage 16 and intake passage 18.

The embodiment of the invention as shown and described above is representative of the inventive principles as stated herein. It is to be understood that variations and departures can be made from the embodiment as shown without, however, departing from the scope of the appended claims.

What is claimed is:

1. In an exhaust gas recirculation valve for an internal combustion engine of the type having a housing defining an exhaust gas inlet and an exhaust gas outlet, a valve operable to control gas flow from the inlet to the outlet, a movable pressure transducer assembly disposed within the housing and operably connected to said valve, and a means for communicating the exhaust gas inlet pressure to the pressure transducer assembly, said transducer comprising:

(a) upper housing shell means having an air bleed passage formed therethrough;

(b) a lower housing shell;

(c) pressure responsive means defining with said upper housing shell an air bleed chamber;

(d) bleed valve means operatively connected to said pressure responsive means for controlling flow through said air passage; and (e) said pressure responsive means including, (i) means defining a passage for communicating said air bleed chamber with the atmosphere, (ii) a flexible diaphragm having portions thereof disposed between said upper and lower housing shells, said flexible diaphragm being movable in response to pressure differentials thereacross between a first position in which said bleed valve means is spaced from said air bleed passage means and a second position in which said bleed valve means substantially restricts flow through said air bleed passage means, (iii) biasing means intermediate said upper housing shell and said flexible diaphragm, said biasing means urging said diaphragm toward said first position, (iv) adjustment means rotatably received in and extending through said upper housing shell and selectively positionable relative to said upper housing shell, (v) abutment means intermediate said upper housing shell means and said biasing means, said adjustment means contacting a portion of said abutment means such that as said adjustment means is selectively advanced toward said abutment means said biasing means increasingly urges said diaphragm toward said first position and increases the spacing of said bleed valve means from said air bleed passage, thereby increasing the pressure differential required to move said flexible diaphragm from said first position to said second position.

2. The device as defined in claim 1 wherein said biasing means is a compression spring substantially coaxially aligned with said air bleed passage means and said bleed valve means.

3. The device as defined in claim 1, wherein said abutment means is an annular member having a cup shaped portion and an outwardly extending flange around one end thereof, with said biasing means seated in said cup shaped portion.

4. The device as defined in claim 1, wherein said adjustment means includes an elongated threaded member in contact with said abutment means, selective advancement of said threaded member being effective to tilt said abutment means, thereby increasing the spacing of said bleed valve means from said air bleed passage means.

5. The device as defined in claim 1, wherein, (a) said biasing means is a compression spring substantially coaxially aligned with said air bleed passage means and said bleed valve means;

(b) said abutment means is an annular member having a cup shaped portion and an outwardly extending flange around one end thereof, said compression spring having one end thereof seated in said cup shaped portion; and (c) said adjustment means includes an elongated threaded member in contact with said flange portion, selective advancement of said threaded member toward said annular member being effective to tilt said annular member, thereby increasing the spacing of said bleed valve means from said air bleed passage means.

6. In an exhaust gas recirculation control valve of the type having an inlet, an outlet and a valve member movable to control flow between said inlet and outlet and a means responsive to pressure in a chamber supplied by a source for moving the valve member and including air bleed valve means for controlling the pressure in the chamber, the improvement comprising:

(a) shell means movable with said pressure responsive means;

(b) means biasing said bleed valve means toward one position;

(c) annular retaining means registered against said shell means and operable to retain said bias means in registration with said bleed valve means and said retaining means being movable with respect to said pressure responsive means for varying the preload of said bias means on said bleed valve means; and (d) adjustment means mounted on said shell means and operable to pivot said annular means about the periphery thereof to vary the position thereof with respect to said shell means for varying the preload on said valve means.

* * * * *